US005463199A

United States Patent [19]

Divincenzo et al.

[11] Patent Number: 5,463,199

[45] Date of Patent: Oct. 31, 1995

[54] DC-RATED CIRCUIT BREAKER WITH ARC SUPPRESSOR

[75] Inventors: Gregory T. Divincenzo, Easton; Stefan Gabrielson, Salisbury, both of Md.

[73] Assignee: Philips Electronics North America Corporation, New York, N.Y.

[21] Appl. No.: 69,958

[22] Filed: May 28, 1993

[51] Int. Cl.[6] ..... H01H 33/04

[52] U.S. Cl. ..... 218/158; 218/156

[58] Field of Search ..... 200/144 R, 144 C, 200/147 R, 147 A, 147 B, 149 A; 218/1, 34, 22, 155, 156, 158, 149, 150, 90

[56] References Cited

U.S. PATENT DOCUMENTS 4,733,032 3/1988 Pardini ..... 200/144

4,970,481 11/1990 Arnold ..... 335/6

FOREIGN PATENT DOCUMENTS 2584230 1/1987 France ..... H01H 9/36

*Primary Examiner*—Kristine L. Kincaid

*Assistant Examiner*—Michael A. Friedhofer

*Attorney, Agent, or Firm*—David R. Treacy

[57] ABSTRACT

A circuit breaker having an arc chute adjacent the arc path between a fixed and a movable contact. To aid in extinguishing the arc under short circuit conditions, an arc suppressor element is fixed on a movable surface adjacent the movable contact; and preferably on the arm itself facing the fixed contact and arc chute. The arc suppressor is made from a thermoplastic material such as nylon 6/6 which has high temperature resistance and high dissipation factor, and absorbs a relatively large amount of water. During interruption of a high current arc, heat shock liberates gases and water vapor from the suppressor material to neutralize arc ions and blow the arc toward the chute.

13 Claims, 1 Drawing Sheet

DC-RATED CIRCUIT BREAKER WITH ARC SUPPRESSOR

BACKGROUND OF THE INVENTION

1. Field of the Invention

The invention relates to compact circuit breakers; and more particularly to such circuit breakers intended for DC circuits operating at relatively low voltages.

Most circuit breakers are rated only for AC use; at the usual U.S. power line frequency of 60 Hz, even if complex structures enabling very fast current limiting are not provided, the reduction of current to zero twice each cycle can still be relied on to keep event time (arc duration) to a maximum of about 8 milliseconds. However, when short circuit DC currents must be interrupted, event times as long as 18 to 30 msec may cause severe damage to internal parts because of overheating.

2. Description of the Prior Art

U.S. Pat. No. 4,970,481 discloses a relatively compact circuit breaker intended for AC use. Because of the proximity of the U-bend end of the fixed contact arm to the movable contact arm when the breaker has opened, there may be a tendency for one end of the arc to transfer from the fixed contact to the arm, rather than to move into the arc chute and be quickly extinguished. To prevent this transfer, a plastic arc shield is fastened over the fixed contact arm adjacent the contact, on the side of the contact away from the arc chute. The arc shield is described only as being formed of plastic and as being insulative.

The '481 patent also refers to U.S. Pat. No. 4,733,032 as describing an arc chute configuration, and composition of the chute support material, which are optimized to rapidly cool and extinguish the arc; and in particular refers to the arc quenching properties of the specific plastic resin material used. The '032 patent teaches a two layer construction of the chute side plates. The outer layer has woven glass fibers, and the inner layer has woven linen fibers, both layers being impregnated with a melamine/formaldehyde resin selected to evolve substantial quantities of high ionization potential gaseous material when heated by the arc.

SUMMARY OF THE INVENTION

An object of the invention is to speed extinguishing of an arc in a circuit breaker by placing a material, which emits a gas when exposed to high temperature shock, where the gas will help to blow the arc into an arc chute.

Another object of the invention is to speed arc extinguishing by placing a material in the breaker cavity which will emit negative ions when heated suddenly, thereby neutralizing some of the positive ion plasma in the arc.

A further object of the invention is to protect the movable contact arm of a circuit breaker from pitting due to transfer of the cathode spot of an arc to the arm.

According to the invention, an arc suppressor is fixed to a movable surface adjacent the movable contact, facing the fixed contact and the arc chute. This surface can be on the contact arm itself, or on the mounting for the movable contact arm or the operating mechanism for pivoting the movable contact arm, so long as it remains adjacent the movable contact during movement of that contact. In a preferred embodiment, the arc suppressor is fixed on the movable contact arm of the circuit breaker, between the arm pivot and the movable contact.

The suppressor is preferably a flat plate of a substantially homogeneous insulative material which is free of plasticizers, fillers or reinforcing fibers, but has a high melting temperature and a relatively high electrical dissipation factor. One readily available type of material having these characteristics is a flame retardant grade of a polyamide resin, such as flame retardant nylon 6/6.

Still more preferably, the suppressor material has high water absorption so that, on exposure to temperature shock accompanying interruption of a short circuit arc, water vapor and negative ion rich gases are evolved.

The invention allows increased DC voltage and current ratings for a compact circuit breaker, while at the same time reducing event time lapse to less than half of that obtained in a breaker having the same construction but lacking the suppressor.

DESCRIPTION OF THE PREFERRED EMBODIMENT

Figure 1:
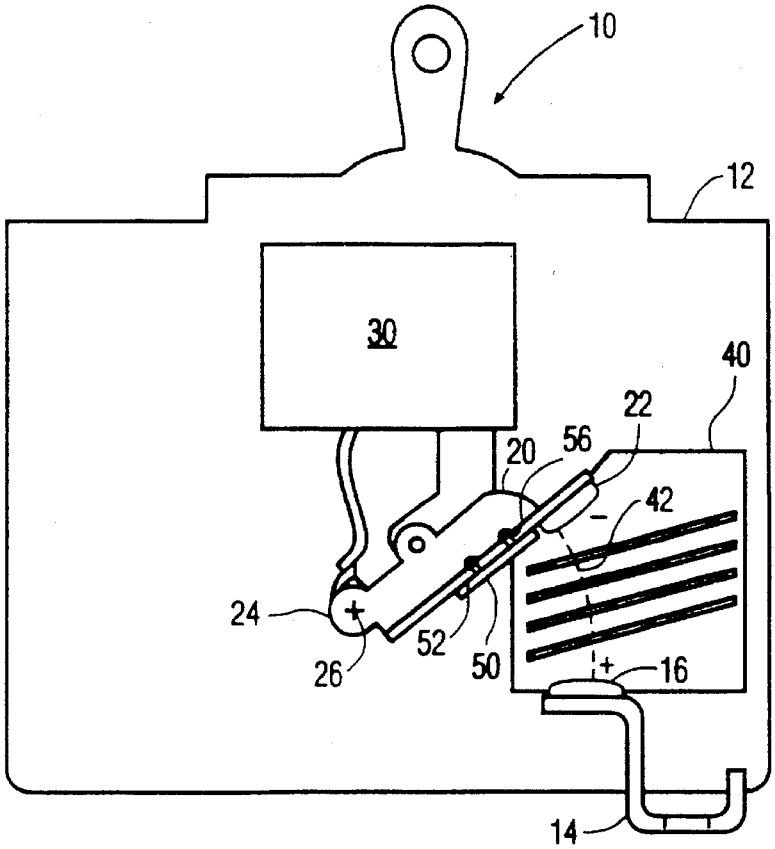
FIG. 1 is a diagrammatic layout of principal parts of a circuit breaker according to the invention.

As shown diagrammatically in FIG. 1, a circuit breaker 10 rated for DC use includes a case 12 in which the other parts are mounted. The positive (line) input connection is to a fixed contact arm 14 having a fixed contact 16 at its inner end. The load is connected through internal wiring and devices (not shown) to a movable contact arm 20 having a contact 22 at one end and a pivot mounting portion 24 for pivoting about an axis 26.

To control movement of the movable arm 20 an operating mechanism 30 is indicated generally. Those of ordinary skill will understand that the mechanism 30 will include linkages for opening and closing the contact set, latching the arm in a closed position with the contacts 16 and 22 pressed together, and violently moving the arm 20 to the open position in the event of a short circuit. An arc chute 40 is fastened adjacent the path 42 that an arc will follow when the contact 22 is first opened, before the forces which will cause it to be extinguished have had much effect.

The parts described above are conventional. When a circuit breaker of this general configuration is required to interrupt a high DC current in a moderate or higher voltage circuit, a problem that can arise is that the end of the arc (cathode spot, for the polarity shown) moves from the contact button 22 to a portion of the arm which, in the open position, is closer to the fixed contact although farther from the arc chute. This can make the arc more difficult to extinguish, as well as causing the movable arm to sustain serious erosion or damage. According to this embodiment of the invention, these problems are eliminated, and arc extinction is greatly speeded, by fixing an arc suppressor element 50 to the movable contact arm surface 52 which faces the fixed contact 16. As shown, the movable surface 52 is adjacent the movable contact 22, between the movable contact and the pivot axis 26, so it remains adjacent the movable contact during movement of that contact.

Figure 2:
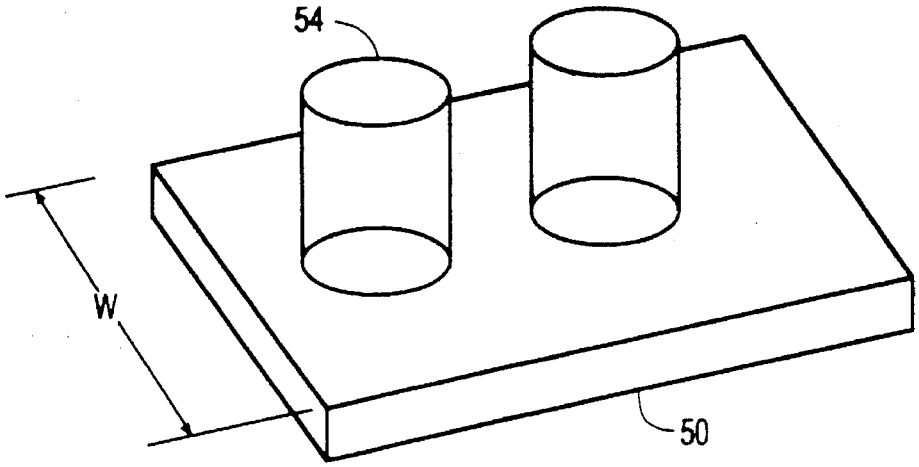
FIG. 2 is a perspective view of an arc suppressor element before fixing to the contact arm.

As shown to enlarged scale in FIG. 2, the arc suppressor 50 is preferably a flat plate having a width W greater than the corresponding width of the movable contact arm 20. Extending from the large face on the contact arm side are two mounting studs 54, molded integrally with the plate, which extend through holes 56 in the arm 20. The studs are preferable deformed after assembly, to form heads which prevent loosening of the arc suppressor on the arm 20. Any well-known method of attachment, which can withstand the high acceleration and shock forces encountered, and the high temperatures which accompany arc interruption, can be used, such as heat staking, cold heading, or snapping in. The studs 54 can be omitted if an adequate bonding technique is used. The thickness of the plate is not critical; because of Underwriters Laboratories requirements, the minimum thickness is about 0.030" (0.75 mm) while a thickness greater than 0.063" (1.5 mm) adds undesirable mass without significant benefit.

The performance of the arc suppressor is closely related to its properties. The material must be able to withstand exposure to a nearby arc whose temperature exceeds 1000° C. The temperature of the arc suppressor material may exceed 150° C. for a number of seconds while the interior of the circuit breaker cools down after interruption of a high current short circuit. A high electrical dissipation factor is desirable; for example, greater than 0.011 at 25° C. and 10 kHz. Polyamide resins are one class of thermoplastic which may have suitable properties; in particular, flame retardant nylon 6/6 has a relatively high water absorption which contributes to snuffing out the arc. The absorbed water is believed to be molecularly bonded at ordinary temperatures, so that exposure to low humidity ambients does not impair performance. However, under the high temperature shock accompanying a short circuit arc, some of the absorbed water is emitted, with two desirable consequences: negative ions are driven out and attracted to the positive ions in the arc plasma, thereby partially neutralizing the arc; and the vapor flow pushes the arc away from the arc suppressor and into the arc chute.

In one set of tests, a number of identical circuit breaker structures as described above, but without an arc suppressor, rated 65 VDC at 5,000 amp interrupting capacity, were supplied with short circuit currents of 10,000 amp from an 80 VDC source. Interruption event times were unpredictable, and varied from 18 to 30 msec. Those tests having the longest event times resulted in destruction of the breaker, although the current was interrupted. In identical tests of identical breaker structures, except for addition of an arc suppressor as described above, the breakers reliably extinguished the arc in 7 to 8 msec without damage.

Those of ordinary skill in the art will recognize that the principle of the invention can be applied with different variations. Similar arc shields may be applied to other, adjacent movable surfaces which face toward the arc chute and the space where the arc will be, at least when the contacts are being opened. The shape of the shield may be adapted to the contact arm to minimize mechanical interference. Insulative materials of substantially different types, such as thermocuring resins or non-resin materials, may be selected because of performance or manufacturing advantages.

What is claimed is:

1. A circuit breaker comprising:

a case, a movable contact and an other contact within said case, forming an electrical switch, an arc chute disposed within said case, adjacent said other contact, a movable contact arm supporting said movable contact, mounting means for mounting said movable contact arm for movement between a closed position and an open position, and an operating mechanism for pivoting said movable contact arm, characterized in that the circuit breaker further comprises an arc suppressor and means for fixing said arc suppressor on a movable surface adjacent the movable contact, said arc suppressor remaining adjacent the movable contact during movement of the movable contact, and said arc suppressor facing said other contact and the arc chute at least when the contact arm is in the open position, the arc suppressor consists of a flat plate and at least one integral mounting stud protruding from one face of the flat plate and passing through a corresponding hole in said surface for fixing said flat plate on said surface, the at least one integral mounting stud forming part of the means for fixing, and at least the flat plate is formed from a substantially homogeneous material having a high melting temperature and dissipation factor, and containing absorbed water releasable upon exposure of the arc suppressor to intense heat from an arc resulting from interruption of a short circuit current.

2. A circuit breaker as claimed in claim 1, characterized in that said material is free from filling and reinforcing fibers.

3. A circuit breaker as claimed in claim 1, characterized in that said material is a nylon 6/6 material.

4. A circuit breaker as claimed in claim 1, characterized in that the arc suppressor consists of said flat plate and said at least one integral mounting stud consisting of two said integral mounting studs.

5. A circuit breaker comprising:

a case, a movable contact and an other contact within said case, forming an electrical switch, a movable contact arm supporting said movable contact, having an arm surface adjacent said movable contact, means for mounting said movable contact arm for pivoting movement about an axis between a closed position and an open position, said arm surface being between said pivot axis and said movable contact and, in said open position, facing said other contact, and an operating mechanism for pivoting said movable contact arm, characterized in that the circuit breaker further comprises a thermoplastic arc suppressor fixed on said arm surface adjacent the movable contact, between said arm surface and said other contact, said arc suppressor consisting of a flat plate and at least one integral mounting stud protruding from one face of the flat plate and passing through a corresponding hole in said surface for fixing said flat plate on said surface, at least the flat plate being formed from a material having a high melting temperature and dissipation factor, and containing absorbed water releasable upon exposure of the arc suppressor to intense heat from an arc resulting from interruption of a short circuit current.

6. A circuit breaker as claimed in claim 5, characterized in that said material is substantially homogenous, and is free from filling and reinforcing fibers.

7. A circuit breaker as claimed in claim 5, characterized in that said material is a nylon 6/6 material.

8. A circuit breaker as claimed in claim 5, characterized in that said arc suppressor consists of said flat plate and said at least one integral mounting stud consisting two integral mounting studs protruding from said one face of the flat plate.

9. A circuit breaker as claimed in claim 5, further comprising an arc chute, in said open position said arc suppressor being disposed between said arm surface and said arc chute, whereby gases released from said arc suppressor upon said exposure to intense heat push the arc toward said chute.

10. A compact DC-rated circuit breaker comprising:

a case, a movable contact and an other contact within said case, forming an electrical switch, a movable contact arm supporting said movable contact, having an arm surface adjacent said movable contact, means for mounting said movable contact arm for pivoting movement about an axis between a closed position and an open position, said arm surface being between said pivot axis and said movable contact and, in said open position, facing said other contact, an operating mechanism for pivoting said movable contact arm, and an arc chute, in said open position said arc suppressor being disposed between said arm surface and said arc chute, characterized in that the circuit breaker further comprises a thermoplastic arc suppressor fixed on said arm surface adjacent the movable contact, between said arm surface and said other contact, said arc suppressor consisting of a flat plate and two integral mounting studs protruding from one face of the flat plate and passing through corresponding holes in said arm surface for fixing said flat plate on said surface, at least the flat plate being formed from a material having a high melting temperature and dissipation factor, and containing absorbed water releasable upon exposure of the arc suppressor to intense heat from an arc resulting from interruption of a short circuit current, whereby gases released from said arc suppressor upon said exposure to intense heat push the arc toward said chute and reduce the duration of a short circuit arc to less than half the duration of said arc in the absence of said suppressor.

11. A circuit breaker as claimed in claim 10, characterized in that said material is substantially homogeneous, and is free from filling and reinforcing fibers.

12. A circuit breaker as claimed in claim 11, characterized in that said material is a nylon 6/6 material, and said absorbed water is molecularly bonded.

13. A circuit breaker as claimed in claim 11, characterized in that said movable contact is the negative contact.

* * * * *